US008632628B2

(12) United States Patent
Kolics

(10) Patent No.: US 8,632,628 B2
(45) Date of Patent: Jan. 21, 2014

(54) SOLUTIONS AND METHODS FOR METAL DEPOSITION

(75) Inventor: Artur Kolics, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 534 days.

(21) Appl. No.: 12/916,427

(22) Filed: Oct. 29, 2010

(65) Prior Publication Data

US 2012/0104331 A1 May 3, 2012

(51) Int. Cl.

| | |
|---|---|
| ***C23C 18/31*** | (2006.01) |
| ***C23C 18/32*** | (2006.01) |
| ***C23C 18/34*** | (2006.01) |
| ***C23C 18/36*** | (2006.01) |
| ***C23C 18/38*** | (2006.01) |
| ***C23C 18/40*** | (2006.01) |
| ***C23C 18/42*** | (2006.01) |
| ***C23C 18/44*** | (2006.01) |

(52) U.S. Cl.

USPC ..... 106/1.18; 106/1.19; 106/1.21; 106/1.22; 106/1.23; 106/1.24; 106/1.25; 106/1.26; 106/1.27; 106/1.28; 106/1.29

(58) Field of Classification Search

USPC ..... 106/1.22, 1.23, 1.24, 1.25, 1.26, 1.27, 106/1.28, 1.29, 1.18, 1.19, 1.21

See application file for complete search history.

(56) References Cited

U.S. PATENT DOCUMENTS

| | | | | |
|---|---|---|---|---|
| 3,793,038 | A * | 2/1974 | Maguire | 106/1.23 |
| 3,864,148 | A * | 2/1975 | Maeawa et al. | 427/217 |
| 4,151,313 | A | 4/1979 | Wajima et al. | |
| 4,169,772 | A * | 10/1979 | Lowery et al. | 205/312 |
| 4,279,951 | A | 7/1981 | Hough et al. | |
| 4,301,196 | A | 11/1981 | McCormack et al. | |
| 4,643,793 | A * | 2/1987 | Nakaso et al. | 106/1.23 |
| 5,152,807 | A | 10/1992 | Sexton et al. | |
| 5,240,497 | A | 8/1993 | Shacham et al. | |
| 5,258,061 | A * | 11/1993 | Martyak et al. | 106/1.22 |
| 5,803,957 | A * | 9/1998 | Murakami et al. | 106/1.26 |
| 5,965,211 | A * | 10/1999 | Kondo et al. | 427/443.1 |
| 6,063,172 | A * | 5/2000 | Bokisa et al. | 106/1.22 |
| 6,065,424 | A | 5/2000 | Shacham-Diamand et al. | |
| 6,534,117 | B1 * | 3/2003 | Yoshio et al. | 427/97.2 |
| 6,717,189 | B2 * | 4/2004 | Inoue et al. | 106/1.23 |
| 6,797,312 | B2 | 9/2004 | Kong et al. | |
| 6,800,121 | B2 | 10/2004 | Shahin | |
| 6,808,612 | B2 | 10/2004 | Hey et al. | |
| 6,911,067 | B2 | 6/2005 | Kolics et al. | |
| 7,087,104 | B2 | 8/2006 | Choi et al. | |
| 7,611,987 | B2 * | 11/2009 | Chen et al. | 438/678 |
| 2003/0113576 | A1 * | 6/2003 | Chebiam et al. | 106/1.22 |
| 2003/0159941 | A1 | 8/2003 | Bajaj et al. | |
| 2003/0235658 | A1 * | 12/2003 | Shacham-diamand et al. | 427/437 |
| 2004/0134375 | A1 | 7/2004 | Kolics et al. | |
| 2009/0162537 | A1 | 6/2009 | Kolics et al. | |

FOREIGN PATENT DOCUMENTS

WO 2012056390 A3 5/2012

OTHER PUBLICATIONS

Tetramethylammonium hydroxide poisoning, Chun-Chi Lin et al., *Clinical Taxicology* (2010), vol. 48, pp. 213-217.

PCT/IB2011/054740 International Search Report Mailed May 30, 2012; Application Filing date Oct. 24, 2011.

* cited by examiner

*Primary Examiner* — Helene Klemanski

(74) *Attorney, Agent, or Firm* — Larry Williams; Williams IPS

(57) ABSTRACT

One aspect of the present invention is a deposition solution to deposit metals and metal alloys such as for fabrication of electronic devices. According to one embodiment, the deposition solution comprises metal ions and a pH adjustor. The pH adjustor comprises a functional group having a general formula $(R_1R_2N)(R_3R_4N)C{=}N{-}R_5$ where: N is nitrogen; C is carbon; and $R_1$, $R_2$, $R_3$, $R_4$, and $R_5$ are the same or different and represent hydrogen, alkyl group, aryl group, or alkylaryl group. Another aspect of the presented invention is a method of preparing deposition solutions. Still another aspect of the present invention is a method of fabricating electronic devices.

30 Claims, No Drawings

SOLUTIONS AND METHODS FOR METAL DEPOSITION

BACKGROUND

This invention pertains to fabrication of electronic devices such as integrated circuits; more specifically, this invention relates to deposition solutions for deposition of metals and/or metal alloys for electronic devices.

Wet chemical processes have become widely adopted for processing electronic devices that use copper metallization. Wet chemical processes such as electroless deposition (ELD) and electrochemical plating (ECP) are used for damascene and dual damascene copper fills for trenches, for deposition of cap or barrier layers, for deposition of adhesion layers, for deposition of seed layers, and other deposition processes. Numerous established deposition processes using a variety of deposition solutions exist and are in use for fabricating such devices.

The present inventor has made one or more discoveries that may be pertinent to deposition solutions suitable for applications such as wet chemical deposition of metals and/or metal alloys that can be used to fabricate electronic devices. The one or more deposition solutions may provide one or more improvements over existing deposition solutions.

SUMMARY

This invention pertains to fabrication of electronic devices. One aspect of the present invention is a deposition solution to deposit metals and metal alloys such as for fabrication of electronic devices. According to one embodiment, the deposition solution comprises metal ions and a pH adjustor. The pH adjustor comprises a functional group having a general formula $(R_1R_2N)(R_3R_4N)C{=}N{-}R_5$ where N is nitrogen; C is carbon; and $R_1$, $R_2$, $R_3$, $R_4$, and $R_5$ are the same or different and represent hydrogen, alkyl group, aryl group, or alkylaryl group. Another aspect of the presented invention is a method of preparing deposition solutions. Still another aspect of the present invention is a method of fabricating electronic devices.

It is to be understood that the invention is not limited in its application to the details of construction and to the arrangements of the components set forth in the following description. The invention is capable of other embodiments and of being practiced and carried out in various ways. In addition, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out aspects of the present invention. It is important, therefore, that the claims be regarded as including such equivalent constructions insofar as they do not depart from the spirit and scope of the present invention.

DESCRIPTION

For the following defined terms, these definitions shall be applied, unless a different definition is given in the claims or elsewhere in this specification. All numeric values are herein defined as being modified by the term "about," whether or not explicitly indicated. The term "about" generally refers to a range of numbers that a person of ordinary skill in the art would consider equivalent to the stated value to produce substantially the same properties, function, result, etc.

A numerical range indicated by a low value and a high value is defined to include all numbers subsumed within the numerical range and all subranges subsumed within the numerical range. As an example, the range 10 to 15 includes, but is not limited to, 10, 10.1, 10.47, 11, 11.75 to 12.2, 12.5, 13 to 13.8, 14, 14.025, and 15.

The term "metal" is used herein to refer to a metal element in the periodic table of the elements and/or to metal alloys comprising one or more metal elements mixed with at least one other element. The metal and the metal alloys have the general properties of metal elements from the periodic table of the elements such as high electrical conductivity.

The operation of embodiments of the present invention will be discussed below, primarily in the context of processing semiconductor wafers such as silicon wafers used for fabricating integrated circuits. The metallization layers for the integrated circuits may involve metal lines such as copper formed into damascene or dual damascene dielectric structures and may have deposited caps comprising chemical elements such as cobalt and such as nickel. Optionally, the dielectric is a low k dielectric material such as a carbon doped silicon oxide (SiOC:H). However, it is to be understood that embodiments in accordance with the present invention may be used for other semiconductor devices, metals other than copper, metals comprising elements other than cobalt and other than nickel, and wafers other than semiconductor wafers.

One or more embodiments of the present invention comprise a deposition solution such as an aqueous solution to form a metal on a substrate. The solution comprises metal ions for deposition and one or more pH adjustors. The metal ions in the deposition solution may be provided by one or more metal salts. The one or more pH adjustors are selected from a group of chemical compounds comprising a functional group having a general formula $(R_1R_2N)(R_3R_4N)C{=}N{-}R_5$ where: N is nitrogen; C is carbon; and $R_1$, $R_2$, $R_3$, $R_4$, and $R_5$ are the same or different and represent hydrogen, alkyl group, aryl group, and/or alkylaryl group. The alkyl group comprises a general formula $C_nH_{2n+1}$ and the aryl group and the alkylaryl group are selected from benzyl and benzylalkyl of formulas $C_6H_5$ and $C_6H_5{-}C_nH_{2n+1}$, respectively. Specific examples of pH adjustors for one or more embodiments of the present invention include but are not limited to guanidine $(NH_2)(H_2N)C{=}NH$ (CAS #113-00-8); 1,1,3,3-tetramethylguanidine $(CH_3\ CH_3N)(CH_3\ CH_3N)C{=}NH$ (CAS #80-70-6); triazabicyclodecene $C_7H_{13}N_3$ (CAS #5807-14-7); other guanidine derivatives; and mixtures thereof. Deposition solutions according one or more preferred embodiments of the present invention comprise pH adjustors having lower toxicity than pH adjustors such as tetramethylammonium hydroxide.

Deposition solutions for one or more embodiments of the present invention may include electroless deposition solutions for oxidation-reduction reactions that are chemically driven without the need for application of an external electrical current to deposit the metal. For the electroless deposition solutions, the metal ions have properties suitable for engaging in electroless reactions to form the metal by electroless deposition.

Embodiments of the present invention for electroless deposition may further comprise one or more reducing agents and optionally comprise one or more complexing agents, one or more buffering agents, one or more surfactants, and one or more additives. Descriptions of electroless deposition technology can be found in U.S. Pat. No. 6,794,288 to Kolics et al.

and U.S. Pat. No. 6,911,067 to Kolics et al.; the contents of all of these patents are incorporated herein, in their entirety by this reference. All of these references are commonly owned by the assignee of the present invention.

Deposition processes for one or more embodiments of the present invention may include electrochemical plating solutions for oxidation-reduction reactions that are driven by the application of an external electrical current to deposit the metal. For the electrochemical plating solutions, the metal ions have properties suitable for engaging in electrochemical plating reactions to form the metal by electrochemical plating. Embodiments of the present invention for electrochemical plating, may further comprise, as options, one or more complexing agents, one or more buffering agents, one or more surfactants, and one or more additives.

It is to be understood that the amount of the one or more pH adjustor(s) is selected so as to be sufficient to provide a desired pH for the deposition solution. The amount will be determined, in part, by the desired pH for the deposition solution, the chemical properties of the pH adjustor, and the amount and chemical properties of the other components of the deposition solution. In summary, an effective amount of the one or more pH adjustor(s) is included so as to produce the desired pH for the deposition solution and/or for dissolving the metal salts. According to one or more embodiments of the present invention, the pH adjustor effects a pH from 4.5 to 14 and all values and subranges subsumed therein for the deposition solution. According to one or more other embodiments of the present invention, the pH adjustor effects a pH from 8 to 11.5 and all values and subranges subsumed therein for the deposition solution.

One embodiment of the present invention is an electroless deposition solution comprising guanidine and/or a guanidine derivative to provide a pH of 4.5 to 14 for the electroless deposition solution. More specifically, the guanidine and/or the guanidine derivative is included in an amount to be capable of raising the pH of the electroless deposition solution to a value in the range of 4.5 to 14 and all values and subranges subsumed therein. According to an embodiment of the present invention, the pH of the electroless deposition solution is a value from about 8 to about 11.5.

A variety of metal ions may be suitable for embodiments of the present invention. According to one embodiment of the present invention, the metal ions comprise ions of cobalt and/or nickel. In other embodiments, the metal ions may comprise or may also comprise antimony, arsenic, cadmium, chromium, copper, gold, indium, iridium, iron, lead, manganese, molybdenum, osmium, palladium, platinum, rhodium, ruthenium, silver, tin, tungsten, zinc, or mixtures thereof.

As an option, one more embodiments of the present invention may have metal ions that comprise first metal ions and second metal ions. The first metal ions and second metal ions are dissimilar. The second metal ions are selected from the $4^{th}$ period of the periodic table, the $5^{th}$ period of the periodic table, and $6^{th}$ period of the periodic table. For one or more embodiments of the present invention, examples of the second metal ions include, but are not limited to, chromium, nickel, copper, zinc, molybdenum, ruthenium, rhodium, palladium, silver, cadmium, indium, tin, antimony, tungsten, rhenium, osmium, iridium, platinum, gold, thallium, and bismuth.

The deposition solution for one or more embodiments of the present invention is formulated so as to form a metal, metal alloy, or metal composite film. Examples of suitable metal films for embodiments of the present invention include, but are not limited to, copper, cobalt, nickel, cobalt tungsten, and cobalt tungsten phosphorus.

A variety of reducing agents may be suitable for embodiments of the present invention. More specifically, electroless deposition solutions according to one or more embodiments of the present invention comprise a reducing agent to form the metal by an electroless deposition reaction. Examples of reducing agents for embodiments of the present invention include, but are not limited to, one or more alkyl, dialkyl and trialkyl amine boranes of the general formula: $R_1R_2R_3NH_{3-n}BH_3$, where $R_1$, $R_2$, and $R_3$ comprise the same or different alkyl groups and n is the number of alkyl groups attached to the amine boranes, where n can be 0, 1, 2, and 3. Additional examples of reducing agents include, but are not limited to, at least one of hypophosphite, borane, borohydride, hydrazine, dimethylamine borane, hypophosphite dimethylamine borane, aldehyde, ascorbate, and thiosulfite. Optionally, the reducing agent comprises hypophosphite introduced into the deposition solution in the form of a compound selected from the group consisting of hypophosphorous acid, an alkali-metal-free salt of hypophosphorous acid, and a complex of a hypophosphorous acid. As another option, one or more metal ion reducing agents such as, but not limited to, Titanium(III), Manganese(II), Copper(I), Cobalt(II) may be used in one or more embodiments of the present invention. One or more embodiments of the present invention include one or more reducing agents present in the electroless deposition solution in amounts ranging from about 0.1 gram per liter to about 10 grams per liter.

One or more embodiments of the present invention further comprise at least one complexing agent. Numerous compounds are suitable for use as complexing agents in embodiments of the present invention. A list of complexing agents for embodiments of the present invention includes, but is not limited to, citrate, tartrate, glycine, pyrophosphate, and ethylenediaminetetraacetic acid. As an option, the complexing agent may be introduced into the deposition solution as one or more acids such as, but not limited to, citric acid, tartaric acid, pyrophosphoric acid, or mixtures thereof. Optionally, one or more embodiments of the present invention may use complexing agents such as, but not limited to, carboxylic acids, hydroxycarboxylic acids, amino acids, phosphonic acid, phytic acid, and combinations thereof. Additional complexing agents for one or more embodiments of the present invention are listed in: *Stability Constants Database and Mini-SCDatabase*, IUPAC and Academic Software, Version 5.3, 2003, Sourby Old Farm, Timble, Otley, Yorks, UK; or National Institute of Standards and Technology Standard Reference Database 46, *Critically Selected Stability Constants of Metal Complexes Database*, compiled by R. M. Smith, A. E. Martell, R. J. Motekaitis, Version 7.0 for Windows, 2003, U.S. National Institute of Standards and Technology Standard Reference Data Program, Gaithersburg, Md. 20899; all of these references are incorporated herein in their entirety by this reference for all purposes. One or more embodiments of the present invention include one or more complexing agent(s) in the electroless deposition solution in amounts ranging from about 0.1 gram per liter to about 150 grams per liter.

Deposition solutions according to one or more embodiments of the present invention may further comprise a buffering agent. The buffering agent is used to aid in maintaining the pH of the deposition solution such as within a pH range preferred for the deposition. A variety of compounds can be used as buffering agents. Boric acid is commonly used as a buffering agent for maintaining the pH in the range 8 to 10.

As an option, one or more embodiments of the present invention may include a deposition solution that also contains one or more surface active agents also known as surfactants.

The surfactants can be added to the deposition solution in order to reduce surface roughness or to modify grain size in the deposited film. Anionic and/or nonionic surface-active agents are preferable, since cationic agents may significantly hamper electroless deposition processes.

Optionally, deposition solutions according to one or more embodiments of the present invention may also include an alloying promoter, which increases a relative amount of alloying elements in the film and makes the film structure more amorphous. Such components can be represented by complexing agents, which form highly stable complexes with cobalt ions. It is recommended that the complex stability of such agents exceeds $10^{10}$. These auxiliary complexing agents have to be used in amounts significantly smaller than the primary complexing agents. Other auxiliary components of this group are ethylenediamine tetraacetic acid, N,N,N'-hydroxyethyleneethylene-diamine triacetic acid, and other similar compounds known to those skilled in the art.

Tsuda and Ishii (U.S. Pat. No. 4,636,255) showed that the addition of N,N,N'-hydroxyethyleneethylenediamine triacetic acid in circa 4-12 mmol/l concentration could significantly increase the content of phosphorus in a nickel-phosphorous (NiP) deposit.

Deposition solutions according to one or more embodiments of the present invention may also include a corrosion inhibitor for substrates, e.g., copper substrates. In order to minimize corrosion of copper in the initial period of deposition, a corrosion inhibitor can be added to the deposition solution. However, these compounds should be added in an amount not detrimental to the purposes of embodiments of the present invention. Examples of such corrosion inhibitors include, but are not limited to, inorganic phosphates, silicates, and long-chain alkyl phosphonic acids, though other compounds can also be used and are known to those skilled in the art.

Deposition solutions according to one or more embodiments of the present invention may also include a deposition accelerator. In order to alter the rate of deposition without changing the composition of the film, the deposition accelerator can be added to the solution. One such accelerator is a boric acid, though other compounds known in the art can also be used.

Deposition solutions according to one or more embodiments of the present invention are aqueous solutions. Preferably, the water used for the solution is high purity deionized water such as that typically used for manufacturing semiconductor devices.

As an option, deposition solutions according to one or more embodiments of the present invention may also contain one or more water-soluble solvents also known as solublizing agents. Numerous compounds are suitable for use as solublizing agents in embodiments of the present invention. A list of solublizing agents for embodiments of the present invention includes, but is not limited to, primary alcohols, secondary alcohols, tertiary alcohols, polyols, ethylene glycol, dimethylsulfoxide, propylenecarbonate, and combinations thereof. Some embodiments of the present invention include one or more water-soluble solvents present in the electroless deposition solution in amounts ranging from about 1 gram per liter to about 800 grams per liter.

One or more embodiments of the deposition solution also include one or more additives such as a complexing agent substantially as described supra, a corrosion inhibitor substantially as described supra, a surface active agent substantially as described supra, a reducing agent (for electroless deposition) substantially as described supra, and a solublizing agent substantially as described supra. This means that additional embodiments of the present invention are described by combinations of these additives and/or other additives provided in the deposition solution. More specifically, the additives and combinations of the additives produce deposition solutions having dissimilar compositions that define dissimilar embodiments of the deposition solutions. The combination of additives and amounts of the additives are selected so that the deposition solution is effective for depositing metal layers that are suitable for applications such as fabricating electronic devices.

Another embodiment of the present invention is an electroless deposition solution for processing an integrated circuit substrate. The electroless deposition solution comprises guanidine and/or a guanidine derivative to provide a pH for the electroless deposition solution of 4.5 to 14 and all values and subranges subsumed therein, at least one metal salt, a reducing agent, a complexing agent, a corrosion inhibitor, a surface active agent, and a solublizing agent. Each of the components of the solution and amounts of each of the components are included so as to make the electroless deposition solution effective for electroless deposition on the integrated circuit substrate. Additional description of properties and compounds for components of the solution for embodiments of the present invention are presented supra.

Having described the components of deposition solutions according to one or more embodiments of the invention, let us consider the steps of a method according to one or more exemplary embodiments of the invention based on the use of one or more of the aforementioned solutions.

One or more of the following embodiments of the present invention will be discussed below, primarily in the context of deposition solutions for depositing metal layers such as metal layers containing cobalt, nickel, and/or tungsten for the formation of barrier layers for copper interconnects in integrated circuits of semiconductor devices. However, it is to be understood that embodiments in accordance with the present invention may be used for deposition solutions other than for barrier layers containing cobalt, nickel, and/or tungsten and for applications other than copper interconnects.

According to one or more embodiments of the present invention, the method comprises three steps, which are described below in more detail. Optionally, all these steps may occur simultaneously.

Hydroxides of a bivalent cobalt [$Co(OH)_2$] and bivalent nickel [$Ni(OH)_2$] are slightly-dissociated bases and therefore they are poorly soluble in water. In a general form, a reaction of the hydroxides with water can be represented as follows:

$$Co(OH)_2 \leftrightarrow CoOH^+ + OH^- \quad (1)$$

$$Ni(OH)_2 \leftrightarrow NiOH^+ + OH^- \quad (2).$$

It is to be understood that embodiments of the present invention are not limited to the use of metal hydroxides as the metal source.

Step 1

According to one or more embodiments of the present invention, the solubility of metal hydroxides such as cobalt hydroxide and such as nickel hydroxide in water is significantly enhanced by dissolving the metal hydroxides in solutions of complexing agents, in which solutions of hydroxides of Ni and Co are obtained by displacing hydroxyl ions $OH^-$ beyond the external boundary of ligands of mono- or polydental complexants such as those presented above. Cobalt and nickel hydroxides are known to be unstable in acidic solutions. The use of complexing agents as their acids can accelerate dissolving of the metals.

For embodiments of the present invention that further comprise the deposition of an additional metal such as tungsten by electroless deposition, the method may further include using a tungsten oxide as the tungsten source for the deposition solution. According to one or more embodiments of the present invention, tungsten trioxides are converted to soluble tungstate ions by using highly alkaline solutions of one or more compounds comprising a functional group having a general formula $(R_1R_2N)(R_3R_4N)C{=}N{-}R_5$ where N is nitrogen; C is carbon; and $R_1$, $R_2$, $R_3$, $R_4$, and $R_5$ are the same or different and represent hydrogen, alkyl group, aryl group, or alkylaryl group. As options for the alkaline solution, the alkyl group comprises a general formula $C_nH_{2n+1}$ and where the aryl group and the alkylaryl group are selected from benzyl and benzylalkyl of formulas $C_6H_5$ and $C_6H_5{-}C_nH_{2n+1}$, respectively. For one or more embodiments of the present invention, the alkaline solution comprises guanidine, guanidine derivative, or mixtures thereof. According to one or more embodiments of the present invention, the alkaline solution is substantially free of alkaline elements, is substantially free of ammonia, and is substantially free of ammonium hydroxides such as alkyl, aryl, and alkylaryl ammonium hydroxides.

Step 2

The second step of this exemplary process includes preparing a complex composition based on a tungsten oxide $WO_3$, phosphorous tungstic acid, such as $H_3[P(W_3O_{10})_4]$, or tungstic acid, as well as on the use of tungsten compounds with other degrees of oxidation. Optionally, the complex composition may be based on substantially any non-alkali metal tungstate, such as for example ammonium tungstate. The presence of tungsten significantly improves anti-corrosive properties of the deposited films for some applications. Embodiments of the present invention exclude the use of alkali-metal salts of tungstic acid, such as $Na_2WO_4$.

As has been mentioned above, one of the problems associated with selection of components of the working media for electroless deposition is that when a tungsten oxide is to be used in the process, the tungsten oxide is practically insoluble in water and acids and therefore cannot be converted directly into an acid, i.e., via a direct reaction with water. However, tungsten trioxides may be converted to soluble tungstate ions, if they are dissolved in a highly alkaline solution. For one or more embodiments of the present invention, the highly alkaline solution comprises one or more compounds having a functional group having a general formula $(R_1R_2N)(R_3R_4N)C{=}N{-}R_5$ where N is nitrogen; C is carbon; and $R_1$, $R_2$, $R_3$, $R_4$, and $R_5$ are the same or different and represent hydrogen, alkyl group, aryl group, or alkylaryl group. As options for the alkaline solution, the alkyl group comprises a general formula $C_nH_{2n+1}$ and where the aryl group and the alkylaryl group are selected from benzyl and benzylalkyl of formulas $C_6H_5$ and $C_6H_5{-}C_nH_{2n+1}$, respectively. For one or more embodiments of the present invention, the alkaline solution comprises guanidine, guanidine derivative, or mixtures thereof.

Step 3

For deposition of coating films, the aforementioned solutions of salts of Co, Ni, or W are mixed and maintained under a temperature within the range of 20° C. to 100° C. The deposited films may include, e.g., $C_{0.9}W_{0.02}P_{0.08}$, $Co_{0.9}P_{0.1}$, $Co_{0.96}W_{0.04}B_{0.001}$, $Co_{0.96}W_{0.0436}B_{0.004}$, $Co_{0.9}Mo_{0.03}P_{0.08}$ or other compounds suitable, e.g., for the formation of barrier layers for copper interconnects in integrated circuits of semiconductor devices.

According to one or more embodiments of the present invention, the metal ions are introduced into the deposition solution as dissolved metal ion salt selected from a group consisting of water soluble metal salts such as but not restricted to metal sulfate, metal chloride, metal hydroxide, and mixtures thereof.

Optionally, deposition solutions according to embodiments of the present invention comprise metal ions that comprise first ions and second-metal ions. The first metal ions and second metal ions are dissimilar. If the second metal ions comprise tungsten, the tungsten is introduced into the deposition solution as tungsten oxides, tungsten phosphoric acids, tungstic acid, or mixtures thereof.

One or more embodiments of the present invention comprise a deposition solution for electroless deposition of a metal. The metal is a cobalt tungsten phosphorous alloy film having a phosphorous content of 2% to 14% and a tungsten content of 0.5% to 5%. The electroless deposition solution comprises a pH adjustor substantially as described above, cobalt ions, tungsten ions, a hypophosphite reducing agent for the cobalt ions and the tungsten ions, a citric acid as a complexing agent for the cobalt ions and the tungsten ions, and a buffering agent.

One or more embodiments of the present invention comprise a deposition solution such as one or more deposition solutions substantially as described above for electroless deposition of a metal. The metal comprises a barrier layer for the formation of copper interconnects in integrated circuits of semiconductor devices and is formed from a material selected from the group consisting of $Co_{0.9}W_{0.02}P_{0.08}$, $Co_{0.9}P_{0.1}$, $Co_{0.96}W_{0.0436}B_{0.004}$, and $Co_{0.9}Mo_{0.03}P_{0.08}$.

One or more embodiments of the present invention comprise a deposition solution such as one or more deposition solutions comprising a pH adjustor substantially as described above and metal ions. The deposition solution further comprises a reducing agent to form the metal by electroless deposition. The reducing agent comprises alkyl, dialkyl and trialkyl amine boranes of the general formula $R_1R_2R_3NH_{3-n}BH_3$, where $R_1$, $R_2$, and $R_3$ comprise the same or different alkyl groups and n is the number of alkyl groups attached to the amine boranes, where n can be 0, 1, 2, and 3; hypophosphite; hydrazine; hypophosphite dimethylamine borane; or mixtures thereof. As another option, metal ion reducing agents such as, but not limited to, Ti(III), Mn(II), Cu(I), and Co(II) may be used. The deposition solution further comprises at least one complexing agent selected from the group consisting of citrate, tartrate, glycine, pyrophosphate, and ethylenediaminetetraacetic acid, and the complexing agents are introduced into the deposition solution as acids. The deposition solution also comprises a buffering agent. The pH of the deposition solution is from 4.5 to 14 including all ranges, subranges, and values subsumed therein. The metal ions are introduced into the deposition solution as dissolved metal ion salt comprising a metal sulfate, a metal chloride, or a metal hydroxide.

One or more embodiments of the present invention comprise a deposition solution comprising a pH adjustor substantially as described above and metal ions. The deposition solution further comprises at least one complexing agent selected from the group consisting of citrate, tartrate, glycine, pyrophosphate, and ethylenediaminetetraacetic acid, and the complexing agents are introduced into the deposition solution as acids. The deposition solution also comprises a buffering agent. The pH of the deposition solution is from 4.5 to 14 including all ranges, subranges, and values subsumed therein. The metal ions are introduced into the deposition solution as dissolved metal ion salt comprising a metal sulfate, a metal chloride, or a metal hydroxide.

One or more embodiments of the present invention provide an alkali-metal-free deposition solution for electroless deposition or an alkali-metal-free deposition solution for electrochemical plating. One or more embodiments of the present invention can make it possible to reduce the amount of highly-volatile, contaminating, and toxic components in the deposition solutions, provide aforementioned solutions with reduced toxicity, improve anti-corrosive properties of the deposited films, minimize the amount of ions of precipitation metals with a high degree of oxidation, exclude or minimize the use of solutions, which have a tendency to the formation of gels and various other colloidal aggregates that may impair properties of deposited metal films, make it possible to use complexing agents in optimal concentrations which improve quality of the deposited films, allow formation of smooth coating films which are free of alkali-metal components, provide aforementioned coating films suitable for formation of barrier/capping layers on semiconductor substrates, and provide a method for forming alkali-metal-free coating films and for manufacturing IC devices at a reduced cost.

One or more embodiments of the present invention provide deposition solutions that are more concentrated than deposition solutions that use pH adjustors such as tetraalkylammonium hydroxides. More specifically, one or more embodiments of the present invention use a pH adjustor such as tetramethylguanidine which is available in significantly higher molarity than tetraalkylammonium hydroxides. The higher molarity of the pH adjustor enables the use of more concentrated deposition solutions. Consequently, a benefit of one or more embodiments of the present invention is that use of the higher concentrations for the deposition solution may produce cost reductions on a per wafer basis and easier process control.

One or more embodiments of the present invention may be used to replace electrochemical plating solutions and/or electroless deposition solutions which include tetramethylammonium hydroxide as a pH adjustor. A possible benefit of using one or more embodiments of the present invention is that the pH adjustors for one or more embodiments of the present invention have significantly lower toxicity than pH adjustors such as tetramethylammonium hydroxide. More specifically, one or more embodiments of the present invention will present lower toxicity and reduced hazards for the preparation of deposition solutions according to embodiments of the present invention and for the deposition solutions because preferred embodiments of the present invention uses pH adjustors having lower toxicities than tetramethylammonium hydroxide. Embodiments of the present invention that use pH adjustors such as guanidine and/or one or more guanidine derivatives do not have the high toxicity and do not present the dangers with respect to skin absorption and inhalation that can occur for tetramethylammonium hydroxide and/or other toxic pH adjustors.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims.

As used herein, the terms "comprises," "comprising," "includes," "including," "has," "having," "at least one of," or any other variation thereof, are intended to cover a non-exclusive inclusion. For example, a process, method, article, or apparatus that comprises a list of elements is not necessarily limited only to those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

What is claimed is:

1. A deposition solution to form a metal on a substrate, the solution comprising metal ions and a pH adjustor, the pH adjustor comprising a functional group having a general formula $$(R_1R_2N)(R_3R_4N)C{=}N{-}R_5$$

where:

N is nitrogen;

C is carbon; and $R_1$, $R_2$, $R_3$, $R_4$, and $R_5$ are the same or different and represent hydrogen, alkyl group, aryl group, or alkylaryl group so as to effect a pH from 4.5 to 14 for the deposition solution; and the deposition solution being alkali-metal free.

2. The deposition solution of claim 1, wherein the alkyl group comprises a general formula $C_nH_{2n+1}$ and where the aryl group and the alkylaryl group are selected from the group consisting of benzyl and benzylalkyl of formulas $C_6H_5$ and $C_6H_5{-}C_nH_{2n+1}$, respectively.

3. The deposition solution of claim 1, wherein the pH adjustor comprises guanidine, guanidine derivative, or mixtures thereof.

4. The deposition solution of claim 1, wherein the pH adjustor comprises tetramethylguanidine, triazabicyclodecene, or mixtures thereof.

5. The deposition solution of claim 1, wherein the pH adjustor effects a pH from 8 to 11.5 for the deposition solution.

6. The deposition solution of claim 1, wherein the metal ions comprise antimony, arsenic, cadmium, chromium, copper, gold, indium, iridium, iron, lead, manganese, molybdenum, osmium, palladium, platinum, rhodium, ruthenium, silver, tin, tungsten, zinc, or mixtures thereof.

7. The deposition solution of claim 1, wherein the metal ions comprise ions of cobalt and/or nickel.

8. The deposition solution of claim 1, wherein the metal ions are introduced into the deposition solution as dissolved metal ion salt selected from the group consisting of a metal sulfate, a metal chloride, a metal hydroxide, and mixtures thereof.

9. The deposition solution of claim 1, further comprising a reducing agent to form the metal by electroless deposition.

10. The deposition solution of claim 1, further comprising a reducing agent to form the metal by electroless deposition, the reducing agent comprising at least one of alkyl, dialkyl and trialkyl amine boranes of the general formula $R_1R_2R_3NH_{3-n}BH_3$, where $R_1$, $R_2$, and $R_3$ comprise the same or different alkyl groups and n is the number of alkyl groups attached to the amine boranes, where n can be 0, 1, 2, and 3.

11. The deposition solution of claim 1, further comprising a reducing agent to form the metal by electroless deposition, the reducing agent comprising at least one of hypophosphite, hydrazine, and dimethylamine borane.

12. The deposition solution of claim 1, further comprising a reducing agent to form the metal by electroless deposition, the reducing agent comprising hypophosphite introduced into the deposition solution in the form of a compound selected from the group consisting of hypophosphorous acid, an alkali-metal-free salt of hypophosphorous acid, and a complex of a hypophosphorous acid.

13. The deposition solution of claim 1, further comprising a reducing agent to form the metal by electroless deposition, the reducing agent comprising hypophosphite dimethylamine borane.

14. The deposition solution of claim 1, further comprising a reducing agent to form the metal by electroless deposition, the reducing agent comprising one or more metal ion reducing agents.

15. The deposition solution of claim 1, further comprising at least one complexing agent selected from the group consisting of citrate, tartrate, glycine, pyro-phosphate, and ethylenediaminetetraacetic acid, the complexing agent being introduced into the deposition solution as acid.

16. The deposition solution of claim 1, further comprising at least one complexing agent being introduced into the deposition solution as citric acid, tartaric acid, pyrophosphoric acid, or mixtures thereof.

17. The deposition solution of claim 1, wherein the metal ions comprise first ions and second-metal ions, the first metal ions and second metal ions are dissimilar, the second metal ions are introduced into the deposition solution as tungsten oxides, tungsten phosphoric acids, tungstic acid, or mixtures thereof.

18. The deposition solution of claim 1, wherein the metal ions comprise first metal ions and second metal ions, the first metal ions and second metal ions are dissimilar, the second metal ions are selected from the $4^{th}$ period of the periodic table, the $5^{th}$ period of the periodic table, and $6^{th}$ period of the periodic table.

19. The deposition solution of claim 1, wherein the metal ions comprise first metal ions and second metal ions, the first metal ions and second metal ions being dissimilar, the second metal ions being selected from a group consisting of chromium, nickel, copper, zinc, molybdenum, ruthenium, rhodium, palladium, silver, cadmium, indium, tin, antimony, tungsten, rhenium, osmium, iridium, platinum, gold, thallium, and bismuth.

20. The deposition solution of claim 1, further comprising a buffering agent.

21. The deposition solution of claim 1, further comprising a buffering agent comprising a boric acid solution for maintaining pH of the deposition solution within the range of 8 to 10.

22. The electroless deposition solution of claim 1, wherein the metal is a cobalt tungsten phosphorous alloy film having a phosphorous content of 2% to 14% and a tungsten content of 0.5% to 5%, the electroless deposition solution comprising: cobalt ions, tungsten ions, a hypophosphite reducing agent for the cobalt and the tungsten ions, a citric acid as a complexing agent for the cobalt and the tungsten ions, and a buffering agent.

23. The deposition solution of claim 1, wherein the metal comprises a barrier layer for the formation of copper interconnects in integrated circuits of semiconductor devices and is formed from a material selected from the group consisting of $Co_{0.9}W_{0.02}P_{0.08}$, $Co_{0.9}P_{0.1}$, $Co_{0.96}W_{0.0436}B_{0.004}$, and $Co_{0.9}Mo_{0.03}P_{0.08}$.

24. The electroless deposition solution of claim 1,
further comprising one or more reducing agents;
optionally comprising one or more complexing agents;
optionally comprising one or more buffering agents; and
optionally comprising one or more surfactants.

25. The electroless deposition solution of claim 1,
optionally comprising one or more complexing agents;
optionally comprising one or more buffering agents; and
optionally comprising one or more surfactants.

26. The electroless deposition solution of claim 1, further comprising one or more reducing agents, one or more complexing agents, one or more buffering agents, and one or more surfactants.

27. The electroless deposition solution of claim 1, further comprising one or more complexing agents, one or more buffering agents, and one or more surfactants.

28. The deposition solution of claim 1,
further comprising a reducing agent to form the metal by electroless deposition, the reducing agent comprising:
alkyl, dialkyl and trialkyl amine boranes of the general formula $R_1R_2R_3NH_{3-n}BH_3$, where $R_1$, $R_2$, and $R_3$ comprise the same or different alkyl groups and n is the number of alkyl groups attached to the amine boranes, where n can be 0, 1, 2, and 3;
hypophosphite;
hydrazine;
hypophosphite dimethylamine borane;
metal ion reducing agents selected from the group consisting of Titanium(III), Manganese(II), Copper(I), and Cobalt(II); and
mixtures thereof;
further comprising at least one complexing agent selected from the group consisting of citrate, tartrate, glycine, pyrophosphate, and ethylenediaminetetraacetic acid, the complexing agents being introduced into the deposition solution as acids;
further comprising a buffering agent
wherein the pH is from 4.5 to 14 including all ranges, subranges, and values subsumed therein; and
wherein the metal ions are introduced into the deposition solution as dissolved metal ion salt comprising:
a metal sulfate,
a metal chloride, or
a metal hydroxide.

29. The deposition solution of claim 1,
further comprising at least one complexing agent selected from the group consisting of citrate, tartrate, glycine, pyrophosphate, and ethylenediaminetetraacetic acid, the complexing agents being introduced into the deposition solution as acids;
further comprising a buffering agent
wherein the pH is from 4.5 to 14 including all ranges, subranges, and values subsumed therein; and
wherein the metal ions are introduced into the deposition solution as dissolved metal ion salt comprising:
a metal sulfate,
a metal chloride, or
a metal hydroxide.

30. An electroless deposition solution to form a metal on a substrate, the electroless deposition solution comprising metal ions, at least one reducing agent, and a pH adjustor comprising guanidine, tetramethylguanidine, triazabicyclodecene, or mixtures thereof so as to effect a pH from 4.5 to 14; the electroless deposition solution being alkali-metal free.

* * * * *